US005395258A

United States Patent [19]

Okumura et al.

[11] Patent Number: 5,395,258

[45] Date of Patent: Mar. 7, 1995

[54] LEVER-TYPE CONNECTOR

[75] Inventors: Hitoshi Okumura; Hajime Kawase; Youichi Nankoh; Satoru Nishide, all of Yokkaichi, Japan

[73] Assignee: Sumitomo Wiring Systems Ltd., Yokkaichi Mie, Japan

[21] Appl. No.: 171,444

[22] Filed: Dec. 22, 1993

[30] Foreign Application Priority Data

Dec. 24, 1992 [JP] Japan ..... 4-093157 U

[51] Int. Cl.[6] ..... H01R 13/629

[52] U.S. Cl. ..... 439/157; 439/372

[58] Field of Search ..... 439/152, 153, 157, 160, 439/372

[56] References Cited

U.S. PATENT DOCUMENTS 4,793,823 12/1988 Cozzens et al. ..... 439/372 X

FOREIGN PATENT DOCUMENTS 4-62772 2/1992 Japan .

2179506 3/1987 United Kingdom .

*Primary Examiner*—Eugene F. Desmond

*Attorney, Agent, or Firm*—Oliff & Berridge

[57] ABSTRACT

A connector includes lever pivotally mounted on a lateral wall of a male connector housing. When a female connector housing is inserted into the male connector housing, a cam follower projection formed on a cover is engaged with a cam groove formed on the lever. The lever is formed of four split pieces: a base plate, a second split piece, a third split piece, and an operating strip. For connecting or disconnecting the connectors, the lever can be expanded to maximize leverage. For storage, the lever can be contracted to minimize the amount of space occupied.

10 Claims, 6 Drawing Sheets

LEVER-TYPE CONNECTOR

BACKGROUND OF THE INVENTION

This invention relates to an improved lever-type connector in which connectors are connected together through leverage, and more particularly to a lever-type connector that is expandable for maximum leverage and contractable for compact storage.

A connector of this type has an advantage that the connection and disconnection can be effected with a small force, and this concept has been applied particularly to multi-pole connectors. Its basic principle is based on the action of a lever, and a conventional construction disclosed, for example, in Japanese Patent Unexamined Publication No. 4-62772 is broadly shown in FIGS. 10(A)–(D).

In FIG. 10(A)–(D), a female connector housing 1 in which female terminals are to be accommodated and a male connector housing 2 in which male terminals are to be accommodated are shown. The female connector housing 1 can be inserted into the male connector housing 2. The male connector housing 2 has a lever 3 with cam grooves 3*a* mounted so as to be pivotable about support shafts 2*a*. On the female connector housing 1 side are cam follower projections 4*a*. The cam follower projections 4*a* are arranged on a cover 4 that is to be put on the female connector housing 1.

The operation of connecting both connector housings 1, 2 is as follows. As shown in FIG. 10 (B), the cam follower projections 4*a* on the cover 4 mounted on the female connector housing I are inserted into the cam grooves 3*a* on the lever 3, respectively. The lever 3 is turned in a direction indicated by the arrow in FIG. 10(B) through the position shown in FIG. 10 (C) to that shown in FIG. 10(D). As a result, the cam follower projections 4*a* and hence the cover 4 are pressed downward by the action of the cams through the cam grooves 3*a* as viewed in FIG. 10 (D). This allows terminals in both connectors to be connected against their mechanical inserting resistance, eventually causing the female connector housing 1 to be inserted into the male connector housing 2 completely.

In the connector of this type, the connector housings are displaced through leverage using the lever 3. Therefore, for connecting the connector housings with a small operating force while surpassing the mechanical inserting resistance of the terminals, a longer lever 3 is preferable. However, if the lever 3 is too long, the entire structure of the connector becomes large, which entails a large mounting space. To overcome this problem, the conventional connector is designed as compact as possible at the sacrifice of the pivotal movement and leverage of the lever.

SUMMARY OF THE INVENTION

The invention has been made in view of the above disadvantages. Accordingly, an object of the invention is to provide a lever-type connector in which the connecting and disconnecting operability is improved without increasing the mounting space.

According to the present invention, there is provided a lever-type connector having a first connector housing, a second connector housing, a lever pivotally attached to the first connector housing and having a cam groove, a cam follower projection projecting from a lateral wall of the second connector housing engaging the cam groove of the lever, wherein by pivotally moving the lever, the cam follower projection is displaced by the cam groove, and structure for selectively expanding and contracting the lever, enabling increased leverage during connection and disconnection and reduced size during storage.

The lever may be split into at least two parts, and the structure for selectively expanding and contracting the lever can include a pair of sidewalls fixed to each of the at least two parts, each of the sidewalls including a slit therein, and a pair of coupling projections on each of the at least two parts, wherein the pair of coupling projections are slidably engageable with the slits.

In another aspect of the invention, the lever is U-shaped and includes a pair of base plates, a pair of first split pieces respectively slidably engageable with the pair of base plates, a pair of second split pieces respectively slidably engageable with the pair of first split pieces, and a pair of operating strips coupled by a bridge member and respectively slidably engageable with the pair of split pieces.

In the thus constructed lever-type connector, the lever is expanded and pivotally moved to connect or disconnect the two connectors. Since the lever becomes long when expanded, the force required for turning the lever is reduced. After the connector has been connected or disconnected, the lever can be contracted, which makes the connector compact as a whole.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

An embodiment of the invention will now be described with reference to FIGS. 1 to 6.

Figure 1:
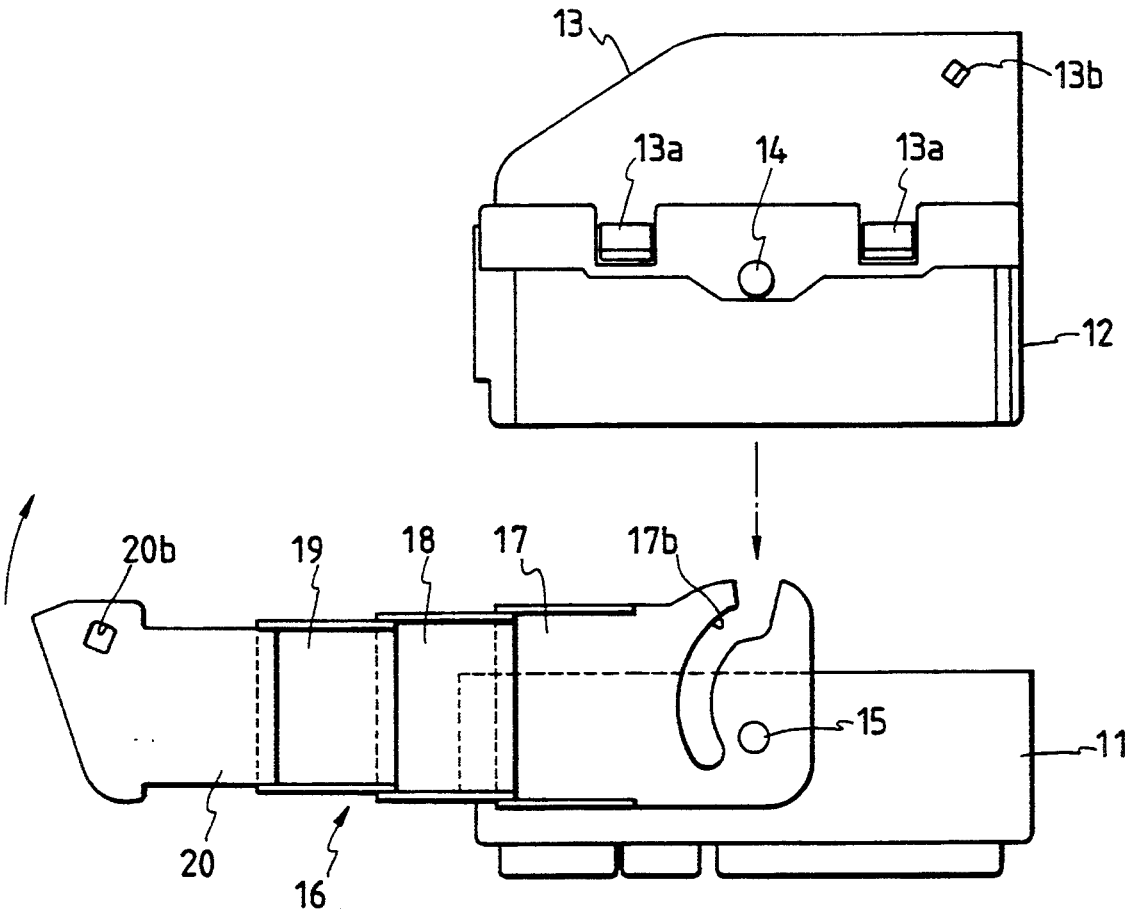
FIG. 1 is a side view of a connector, which is an embodiment of the invention, in a disconnected state.
Figure 2:
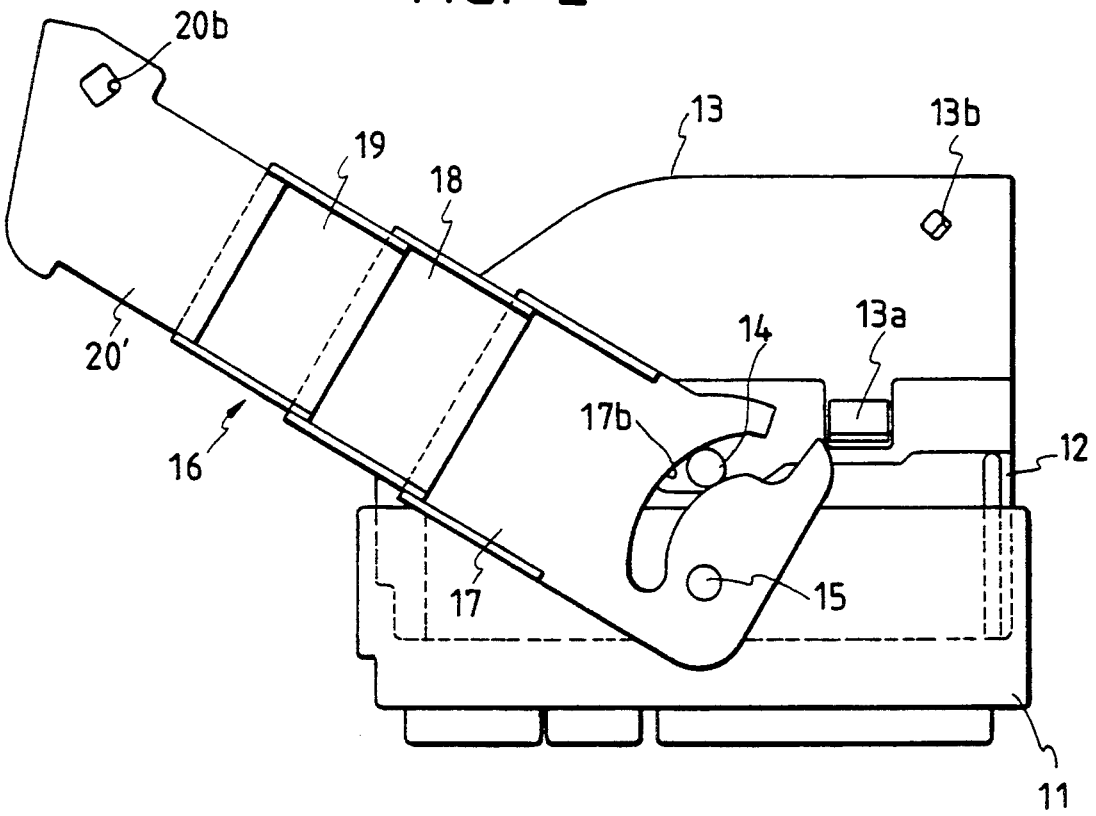
FIG. 2 is a side view of the connector in the course of performing a connecting operation.

FIG. 1 shows an overall structure. A male connector housing 11 into which male terminals (not shown) are to be inserted is shown in the lower side, whereas a female connector housing 12 into which female terminals are inserted is shown in the upper side.

Above the female connector housing 12 is a cover 13, which is designed to entirely cover the upper surface of the female connector housing. The cover 13 is engaged with the female connector housing 12 by an engaging mechanism 13*a*. Cam follower projections 14 are formed on and project laterally in the middle of lateral walls of the female connector housing 12.

The male connector housing 11 is suitably shaped so that the female connector housing 12 can be inserted from an opening formed on the upper surface of the male connector housing. A lever 16 is mounted so as to be pivotable about a lever support shaft 15 projected from one of the lateral walls thereof.

Figure 6:
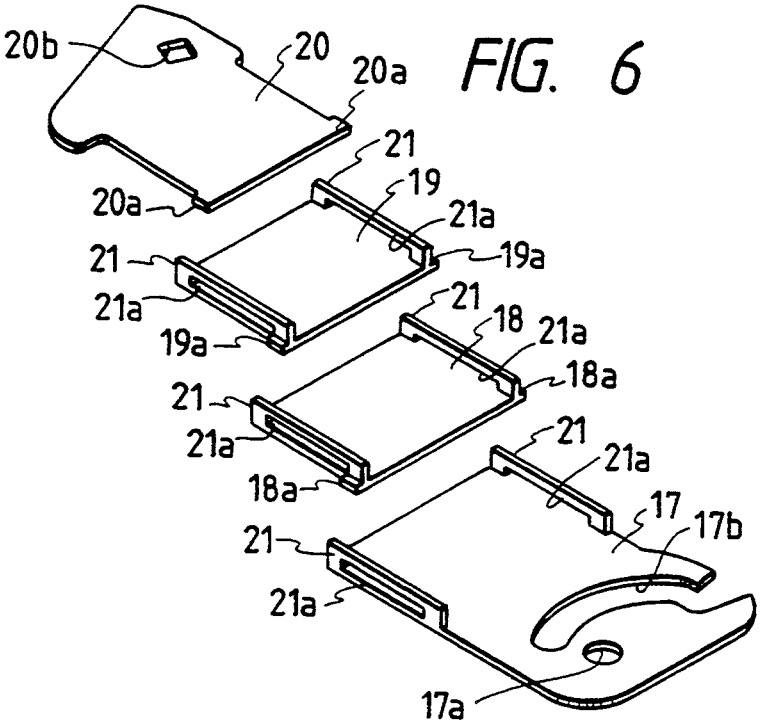
FIG. 6 is an exploded perspective view of the lever.

As shown in FIG. 6 in detail, the lever 16 is formed by combining a plurality of split pieces. There are four split pieces constituting the lever 16, which are a base plate 17, a second split piece 18, a third split piece 19, and an operating strip 20. The base plate 17 has not only a bearing hole 17*a* but also a cam groove 17*b*. The bearing hole 17*a* is arranged to be engaged with the lever support shaft 15 of the male connector housing 11. The cam groove 17*b* is arcuate and has an opening on one end thereof. On an end of the base plate 17 opposite to the bearing hole 17*a* side are a pair of rising walls 21, which stand on both lateral sides (right and left). Slits 21*a* are formed in the rising walls 21, respectively. From one end of the second split piece 18 project a pair of coupling projections 18*a*, one rightward and the other leftward. These projections 18*a* are engaged with the slits 21*a* of the base plate 17. Accordingly, the second split piece 18 is slidably coupled to the base plate 17.

Figure 3:
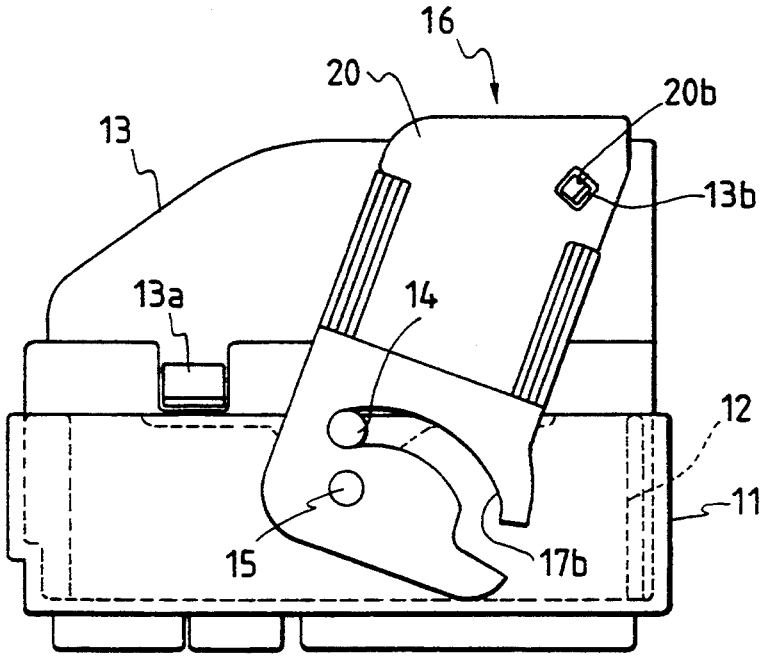
FIG. 3 is a side view of the connector in a connected state.

On the other end of the second split piece 18 are rising walls 21 and slits 21*a* similar to those of the base plate 17, whereas on one end of the third split piece 19 are coupling projections 19*a* similar to those of the second split piece 18. The coupling projections 19*a* of the third split piece 19 are engaged with the slits 21*a* of the second split piece 18. Accordingly, the third split piece 19 is slidably coupled to the second split piece 18. On the other end of the third split piece 19 are rising walls 21 and slits 21*a* similar to those of the second split piece 18, whereas on one end of the operating strip 20 are coupling projections 20*a* similar to those of the second split piece 18. The coupling projections 20*a* of the operating strip 20 are engaged with the slits 21*a* of the third split piece 19. Accordingly, the operating strip 20 is slidably coupled to the third split piece 19. As a result, the respective split pieces 17 to 20 constitute the lever as a whole in four-stage slidable coupling form. The operating strip 20 has an engaging hole 20*b* with which an engaging projection 13*b* formed on and projected from the cover 13 is engaged when the lever 16 is in a contracted state while turned to a connected position as shown in FIG. 3.

Figure 4:
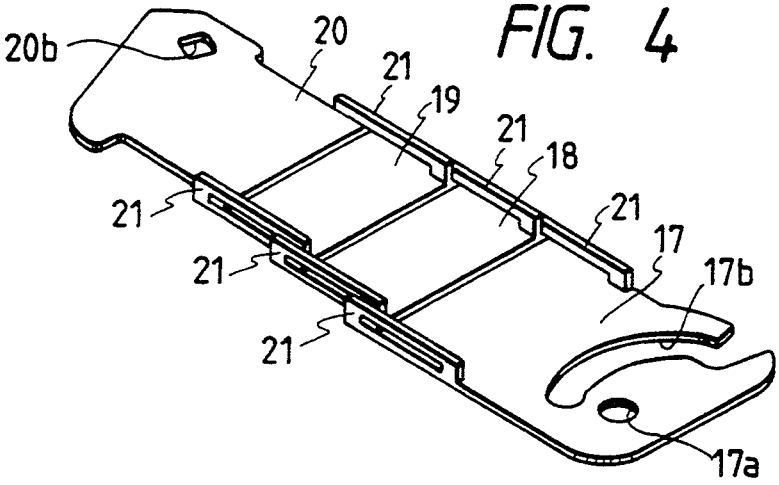
FIG. 4 is a perspective view of a lever in an expanded state.
Figure 5:
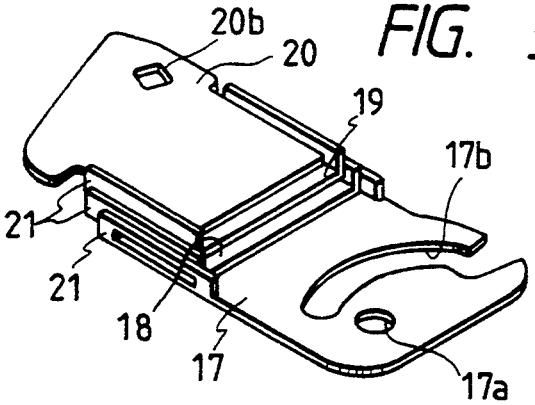
FIG. 5 is a perspective view of the lever in a contracted state.

To connect the connector housing 11, 12, the operating strip 20 of the lever 16 is held and pulled, and the respective split pieces 17 to 20 slide in an expanding direction to cause the lever 16 to be in an expanded state, as shown in FIGS. 1 and 4. Then, with the lever 16 set to an open position so that the open end of the cam groove 17*b* faces upward, the lower portion of the female connector housing 12 is inserted into the male connector housing 11. As a result, the cam follower projection 14 on the cover 13 enters into the cam groove 17*b* of the lever 16.

When the operating strip 20 of the lever 16 is turned in a direction indicated by the arrow shown in FIG. 1, the cam groove 17*b* of the lever 16 and the cam follower projection 14 are engaged with each other. As a result, the cam follower projection 14 is biased by the cam groove 17*b* of the lever 16 in a downward direction as viewed in FIG. 2, and the cover 13 having the cam follower projection 14 and hence the female connector housing 12 are pushed onto the male connector housing 11. Further, as shown in FIG. 3, when the cam follower projection 14 has reached a bottom of the cam groove 17*b*, the female and male terminals accommodated in both connector housings 11, 12 are connected to each other completely.

Once the connecting operation has been completed, the operating strip 20 of the lever 16 is pushed toward the base plate 17. As a result, the respective split pieces 17 to 20 are slidingly superposed upon each other, thereby bringing the lever 16 in the contracted state such as that shown in FIGS. 3 and 5. Thus, as shown in FIG. 3, if the engaging hole 20*b* of the operating strip 20 is engaged with the engaging projection 13*b* on the cover 13, the lever 16 becomes locked in the connected position. In the contracted state, the lever 16 becomes compact, making the connector extremely small as a whole.

For disconnecting both connector housings 11, 12 from the connected state shown in FIG. 3, the lever 16 is released, and the operating strip 20 of the lever 16 is held and pulled out, so that the lever 16 is returned to its expanded state. Then, the lever 16 is turned.

As described above, according to this embodiment, the lever 16 is formed so as to be expandable. Therefore, the lever 16 is expanded and pivotally moved only when necessary to connect or disconnect the connectors. As a result, the connectors can be connected or disconnected with a small operating force, maximizing the leverage of lever 16, thereby making the operation extremely simple. Further, since the lever 16 can be contracted when the connecting or disconnecting operation has been completed, the connector can be made compact.

Still further, if the length of the lever 16 is gradually adjustable to any desired value as in the above embodiment, the same lever 16 can be shared in common among connectors whose connector housings have different sizes. Therefore, one type of lever that is fabricated by a single mold can be used in common among, for example, connectors whose numbers of poles are different. This makes it possible to reduce expenses for the mold as well as the number of parts, thereby contributing to a general reduction in the manufacturing cost.

Figure 7:
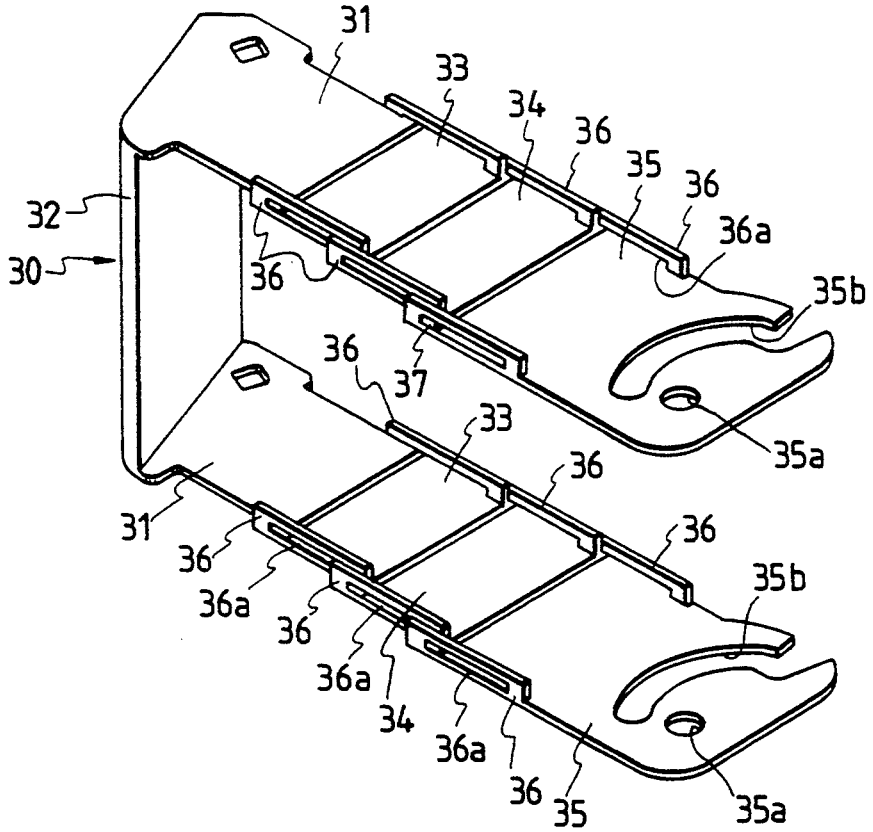
FIG. 7 is a perspective view of a lever, which is a second embodiment of the invention, in an expanded state.
Figure 8:
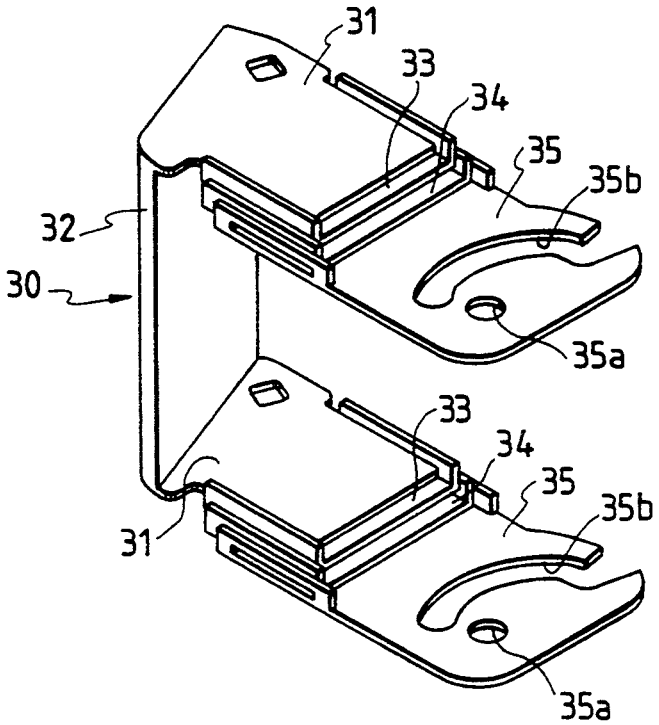
FIG. 8 is a perspective view of the lever shown in FIG. 7 in a contracted state.
Figure 9:
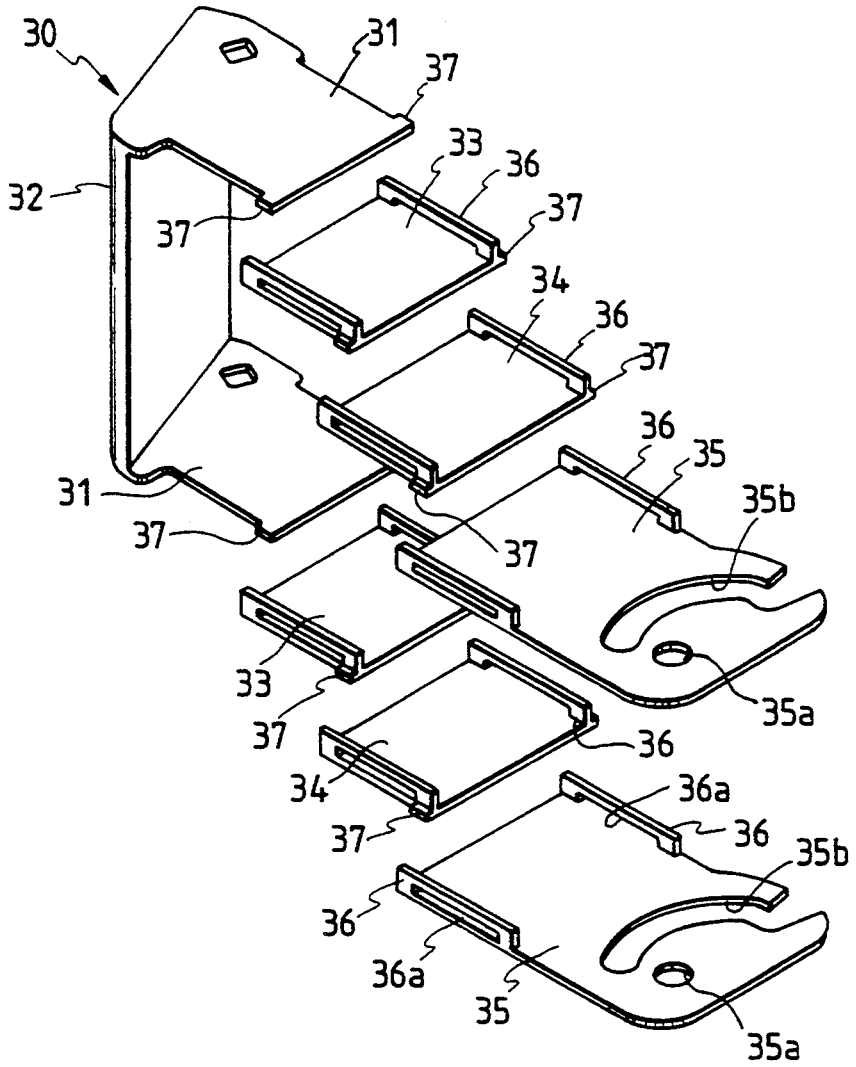
FIG. 9 is an exploded perspective view of the lever shown in FIG. 7.
Figure 10A:
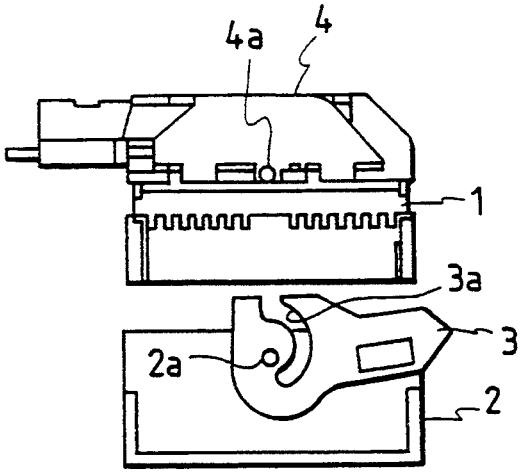
PRIOR ART FIG. 10A
FIGS. 10 (A) to (D) are schematic side views of a conventional lever-type connector.
Figure 10B:
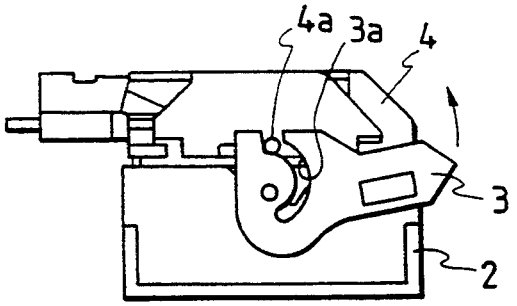
Figure 10C:
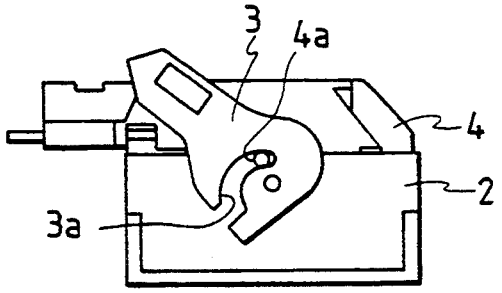
Figure 10D:
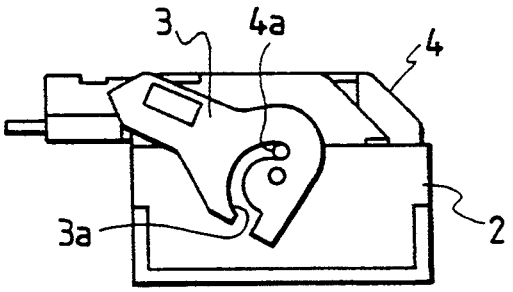

FIGS. 7 to 9 show a second embodiment of the invention, in which the shape of the lever is different from that of the first embodiment. A lever 30 of the second embodiment is of a two-leg type. More specifically, a pair of operating strips 31 are coupled at a bridge portion 32 so as to be U-shaped. Coupled to an end of each operating strip 31 are a third split piece 33, a second split piece 34, and a base plate 35 similar to those of the first embodiment. The manner in which coupling projections 37 are slidably coupled to slits 36*a* formed on rising walls 36 is the same as in the first embodiment. The lever 30 is pivotally supported by the male connector housing 11 with the bearing holes 35*a* formed on the respective base plates 35 engaged with the lever support shafts 15. In addition, the action of the cam can be performed when the cam follower projections 14 arranged on the cover 13 of the female connector housing 12 are engaged with cam grooves 35*b*.

The present invention is not limited to the above embodiments, and for example the following modifications can be made.

(1) In the above embodiments, although the cam follower projection 17 is arranged on the cover 13 that is put on the female connector housing 12, the cam follower projection may be arranged on the female connector housing itself.

(2) The lever may be arranged on the female connector housing and the cam follower projection may be arranged on the male connector housing.

(3) As an expandable lever, not only such a type that the split pieces are slidably superposed as described above but also such a type that split sleeves whose diameters are gradually reduced are fastened to one another to make the entire lever expandable may be used.

As described above, according to the lever-type connector of the invention, the length of the lever is increased only when necessary. Therefore, the connecting and disconnecting operability of the connector can be improved without increasing the mounting space.

While the embodiments disclosed herein are preferred, it will be appreciated from this teaching that various alternatives, modifications, variations or improvements therein may be made by those skilled in the art that are within the scope of the invention, which is defined by the following claims.

What is claimed is:

1. A lever-type connector including a lever pivotally mounted on a first connector housing, a cam follower projection disposed on a second connector housing, said cam follower projection engageable with a cam groove formed on said lever, wherein by pivotally moving said lever, said cam follower projection is displaced so that said first and second connectors are connected and disconnected, said lever comprising a plurality of split pieces attached in an expandable manner.

2. A lever-type connector comprising:

a first connector housing;

a second connector housing;

a lever pivotally attached to said first connector housing, said lever having a cam groove;

a cam follower projection projecting from a lateral wall of said second connector housing, said cam follower projection engaging said cam groove of said lever, wherein by pivotally moving said lever, said cam follower projection is displaced by said cam groove; and means for selectively expanding and contracting said lever, enabling increased leverage during connection and disconnection and reduced size during storage.

3. A lever-type connector as claimed in claim 2, wherein said lever is split into at least two parts, said means for selectively expanding and contracting said lever comprising:

a pair of side walls fixed to each of said at least two parts, each of said side walls including a slit therein; and a pair of coupling projections on each of said at least two parts, said pair of coupling projections being slidably engageable with said slits.

4. A lever-type connector as claimed in claim 2, wherein said lever comprises a base plate, a first split piece slidably engageable with said base plate, a second split piece slidably engageable with said first split piece, and an operating strip slidably engageable with said second split piece, said base plate, first split piece, second split piece and operating strip constituting said means for selectively expanding and contracting said lever.

5. A lever-type connector as claimed in claim 4, wherein said cam groove is formed in a first end of said base plate, said base plate further comprising a pair of side walls disposed at a second end of said base plate and perpendicular to said base plate, each of said side walls having a slit therein, said first split piece comprising a pair of coupling projections at a first end of said first split piece and a pair of side walls disposed at a second end of said first split piece and perpendicular to said first split piece, said pair of coupling projections slidably engageable in said slits in said side walls of said base plate, said second split piece comprising a pair of coupling projections at a first end of said second split piece and a pair of side walls disposed at a second end of said second split piece and perpendicular to said second split piece, said pair of coupling projections slidably engageable in said slits in said side walls of said first split piece, said operating strip comprising a pair of coupling projections at a first end of said operating strip, said pair of coupling projections slidably engageable in said slits in said side walls of said second split piece.

6. A lever-type connector as claimed in claim 5, further comprising a cover for covering an upper surface of said second connector housing, said operating strip comprising an engaging hole through a second end thereof, wherein said engaging hole is engageable with a projection formed on said cover.

7. A lever-type connector as claimed in claim 2, wherein said lever is U-shaped and comprises a pair of base plates, a pair of first split pieces respectively slidably engageable with said pair of base plates, a pair of second split pieces respectively slidably engageable with said pair of first split pieces, and a pair of operating strips coupled by a bridge member and respectively slidably engageable with said pair of second split pieces, said base plates, first split pieces, second split pieces and operating strips constituting said means for selectively expanding and contracting said lever.

8. A lever-type connector as claimed in claim 7, wherein said cam groove is formed in a first end of said base plates, each of said base plates further comprising a pair of side walls disposed at a second end of said base plates and perpendicular to said base plates, each of said side walls having a slit therein, each of said first split pieces comprising a pair of coupling projections at a first end of said first split pieces and a pair of side walls disposed at a second ends of said first split pieces and perpendicular to said first split pieces, said pair of coupling projections slidably engageable in said slits in said side walls of said base plates, each of said second split pieces comprising a pair of coupling projections at a first end of said second split pieces and a pair of side walls disposed at a second end of said second split pieces and perpendicular to said second split pieces, said pair of coupling projections slidably engageable in said slits in said side walls of said first split pieces, each of said operating strips comprising a pair of coupling projections at a first end of said operating strips, said pair of coupling projections slidably engageable in said slits in said side walls of said second split pieces.

9. A lever-type connector as claimed in claim 8, further comprising a cover for covering an upper surface of said second connector housing, each of said operating strips comprising an engaging hole through a second end thereof, wherein said engaging holes are engageable with a projection formed on said cover.

10. A lever-type connector comprising:

a first connector housing;

a second connector housing;

a lever pivotally attached to said first connector housing, said lever having a cam groove; and a cam follower projection projecting from a lateral wall of said second connector housing, said cam follower projection engaging said cam groove of said lever, wherein by pivotally moving said lever, said cam follower projection is displaced by said cam groove, wherein said lever comprises a base plate, a first split piece slidably engageable with said base plate, a second split piece slidably engageable with said first split piece, and an operating strip slidably engageable with said second split piece.

* * * * *